US009004309B1

(12) United States Patent
Gardner

(10) Patent No.: US 9,004,309 B1
(45) Date of Patent: Apr. 14, 2015

(54) BUCKET STABILIZER

(71) Applicant: George R. Gardner, Westminster, CO (US)

(72) Inventor: George R. Gardner, Westminster, CO (US)

( * ) Notice: Subject to any disclaimer, the term of this patent is extended or adjusted under 35 U.S.C. 154(b) by 0 days.

(21) Appl. No.: 14/156,612

(22) Filed: Jan. 16, 2014

(51) Int. Cl.
*B65D 25/24* (2006.01)
*B01F 15/00* (2006.01)

(52) U.S. Cl.
CPC ..... *B01F 15/00733* (2013.01); *Y10S 220/908* (2013.01)

(58) Field of Classification Search
CPC ..... A47G 23/02; B65D 25/24
USPC ..... 220/630, 636, 495.01, 908; 248/146, 248/346.01, 346.03, 500; 366/349
See application file for complete search history.

(56) References Cited

U.S. PATENT DOCUMENTS 7,261,262 B2 8/2007 Dunson
7,651,060 B2 1/2010 Roth et al.
8,136,691 B2 3/2012 Saunders

*Primary Examiner* — Elizabeth Volz
(74) *Attorney, Agent, or Firm* — Crossley Patent Law

(57) ABSTRACT

A bucket stabilizer including a disk-shaped base with an annular wall having a top perimeter, an inner surface, an outer surface, and a lower perimeter continuously disposed on the base. A plurality of securement tines are disposed on the inner surface proximal the top perimeter and are configured to removable secure a bottom portion of a five gallon mixer bucket. Right angled brackets configured to support the mixer bucket are disposed on the inner surface. A hemispherical opening configured to receive a user's foot to stabilize the device.

13 Claims, 4 Drawing Sheets

BUCKET STABILIZER

BACKGROUND OF THE INVENTION

Various types of holder for mixer buckets are known in the prior art. However, what is needed is a bucket stabilizer that allows a user to place a foot through an opening in the device to apply weight to increase stability of the device and bucket secured therein while operating a power mixer to mix the contents of the bucket. Five gallon mixer buckets are used for mixing grout, mortar, cement, paint, dry wall mud and any addition materials that require mixing before use. Currently, while mixing these materials with a power mixer, the five gallon mixing bucket spins and can cause tipping and spilling. The loss of spilled materials is costly. The bucket stabilizer speeds up the preparation of these mixed materials allowing work to proceed in a timely and efficient manner. The device simplifies the mixing process and avoids time consuming, costly cleanup of spills. The device further reduces the struggle and strain of holding the container stationary and reduces risk of personal injury in the process. The bucket stabilizer is stackable, user-friendly, affordable, strong and practical. The bucket stabilizer is made of high-density polyethylene for strength and durability and can alternately be made of materials that promote the functions of the present device.

FIELD OF THE INVENTION

The present invention relates to holders for mixer buckets, and more particularly, to a bucket stabilizer.

SUMMARY OF THE INVENTION

The general purpose of the present bucket stabilizer, described subsequently in greater detail, is to provide a bucket stabilizer which has many novel features that result in a bucket stabilizer which is not anticipated, rendered obvious, suggested, or even implied by prior art, either alone or in combination thereof.

To accomplish this, the present bucket stabilizer includes an annular wall having a top perimeter, an inner surface, an outer surface, and a lower perimeter. A disk-shaped bottom side is continuously attached to the lower perimeter. A hemispherical opening having a convex top side is disposed on the wall proximal the lower side. The opening is configured to receive a user's foot therethrough to stabilize the device during use.

A plurality of spaced apart brackets with a lower side and an lower side are disposed on the inner surface. The first side is disposed vertically on the inner surface and the second side is disposed horizontally in a position parallel the bottom side. The brackets are configured to support a bottom side of a five gallon mixer bucket.

A plurality of spaced apart semi-rigid triangular securement tines having a base and an apex with the base is disposed on the inner surface proximal the top perimeter in a position parallel to the bottom side. The securement tines are configured to removably secure a bottom portion of a five gallon mixer bucket between the inner surface of the wall and the bottom portion.

The bucket stabilizer has a height of 17.4 inches tall and a diameter of 11.6 inches. The hemispherical opening for a user's foot is 6 inches wide.

Thus has been broadly outlined the more important features of the present bucket stabilizer so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
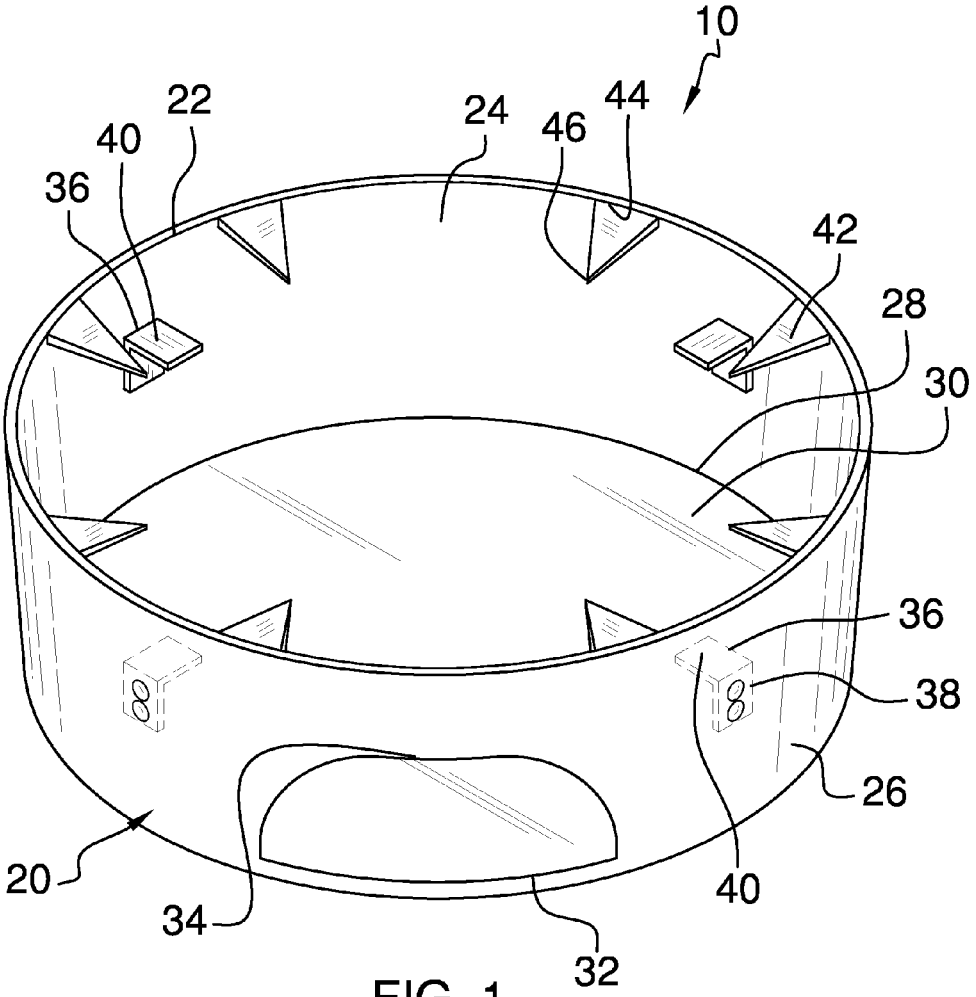
FIG. 1 is an isometric view.
Figure 2:
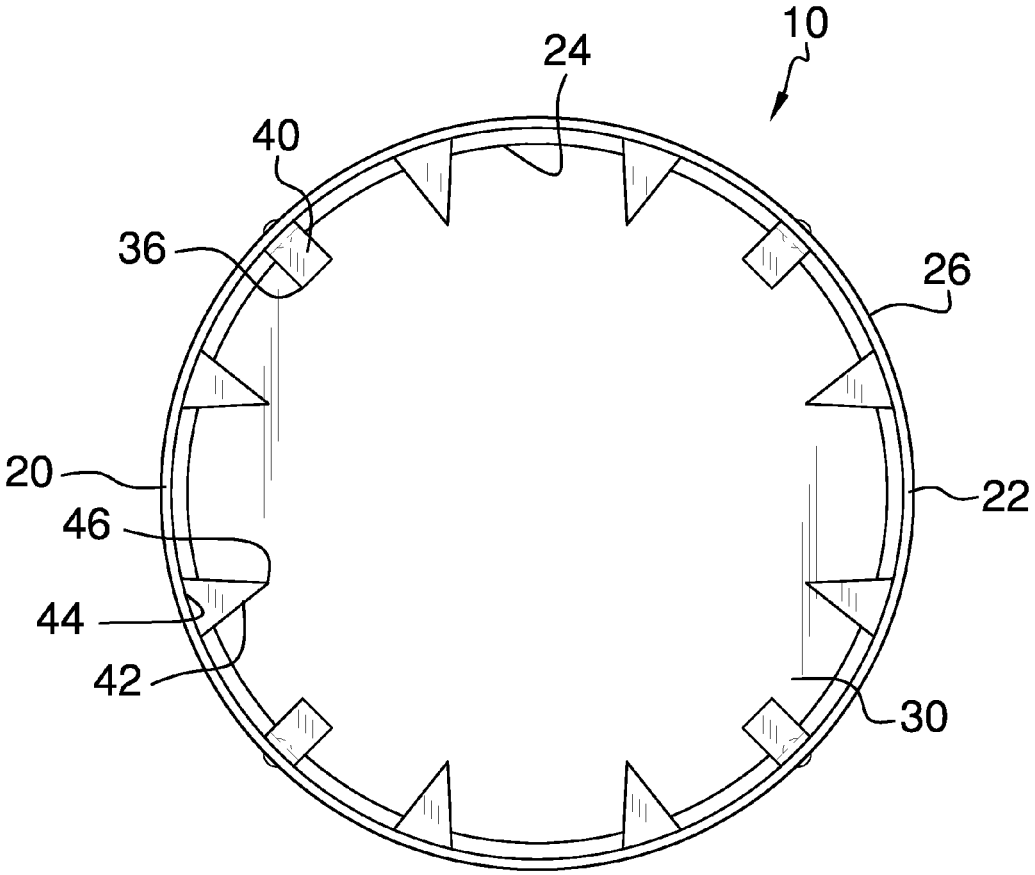
FIG. 2 is a top plan view.
Figure 3:
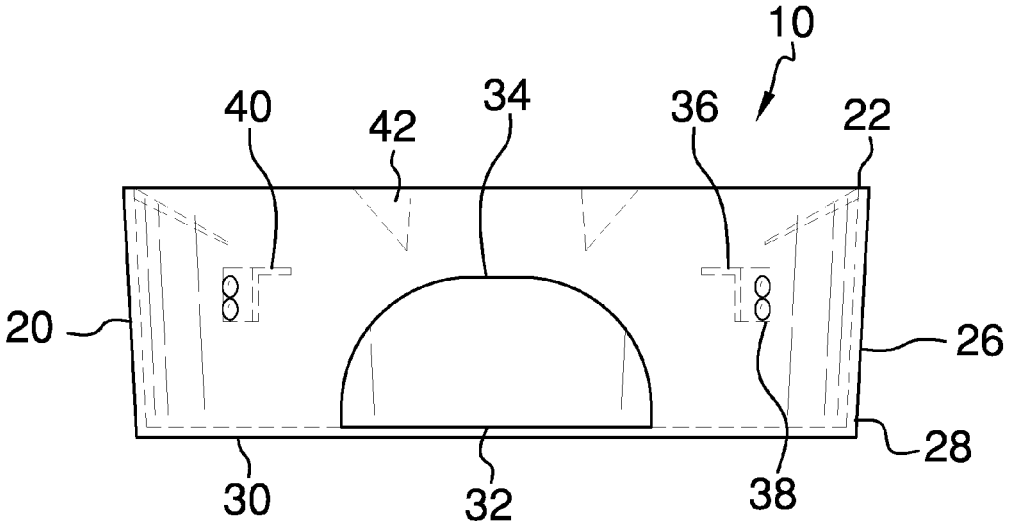
FIG. 3 is a front view.
Figure 4:
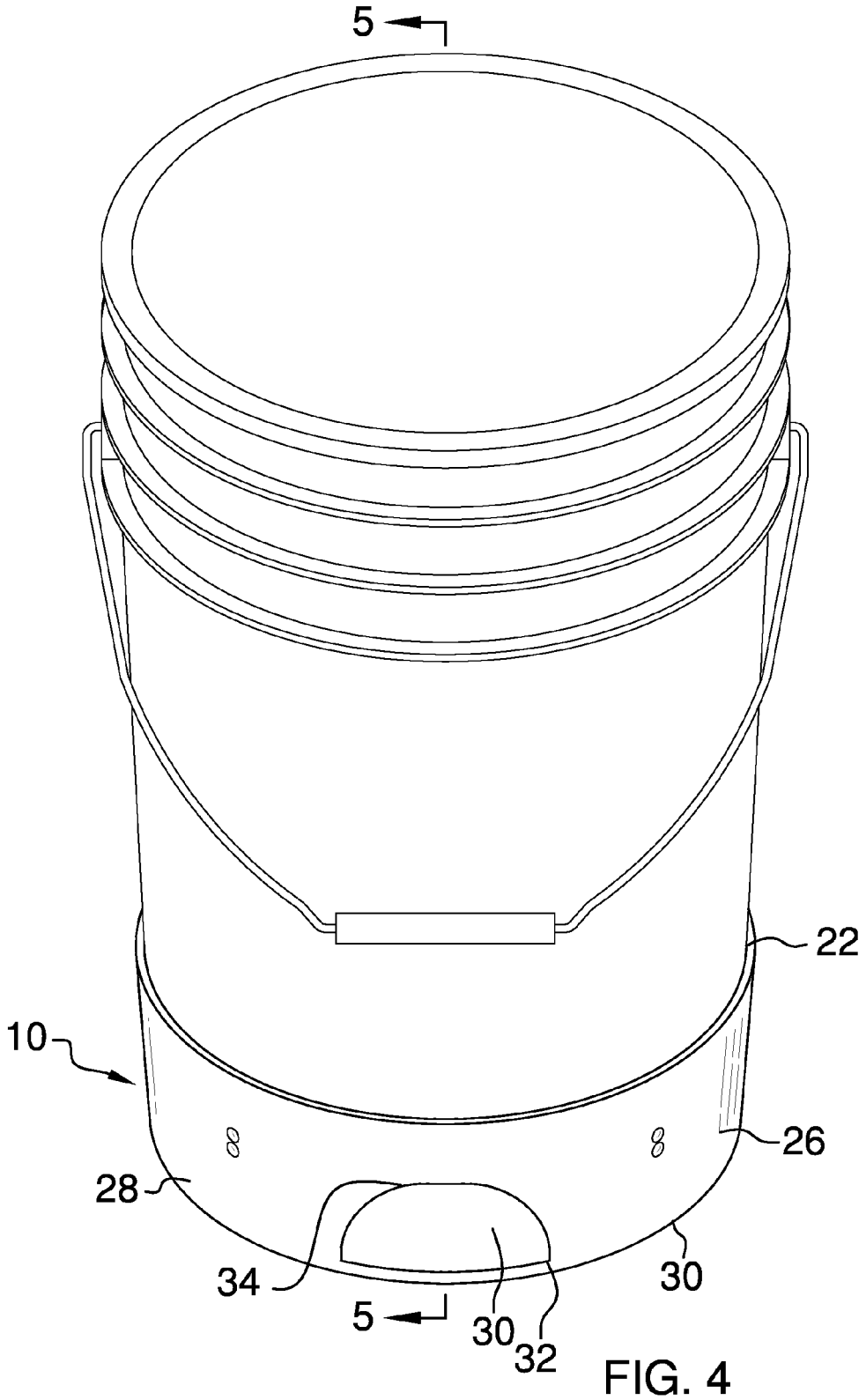
FIG. 4 is an in use view.
Figure 5:
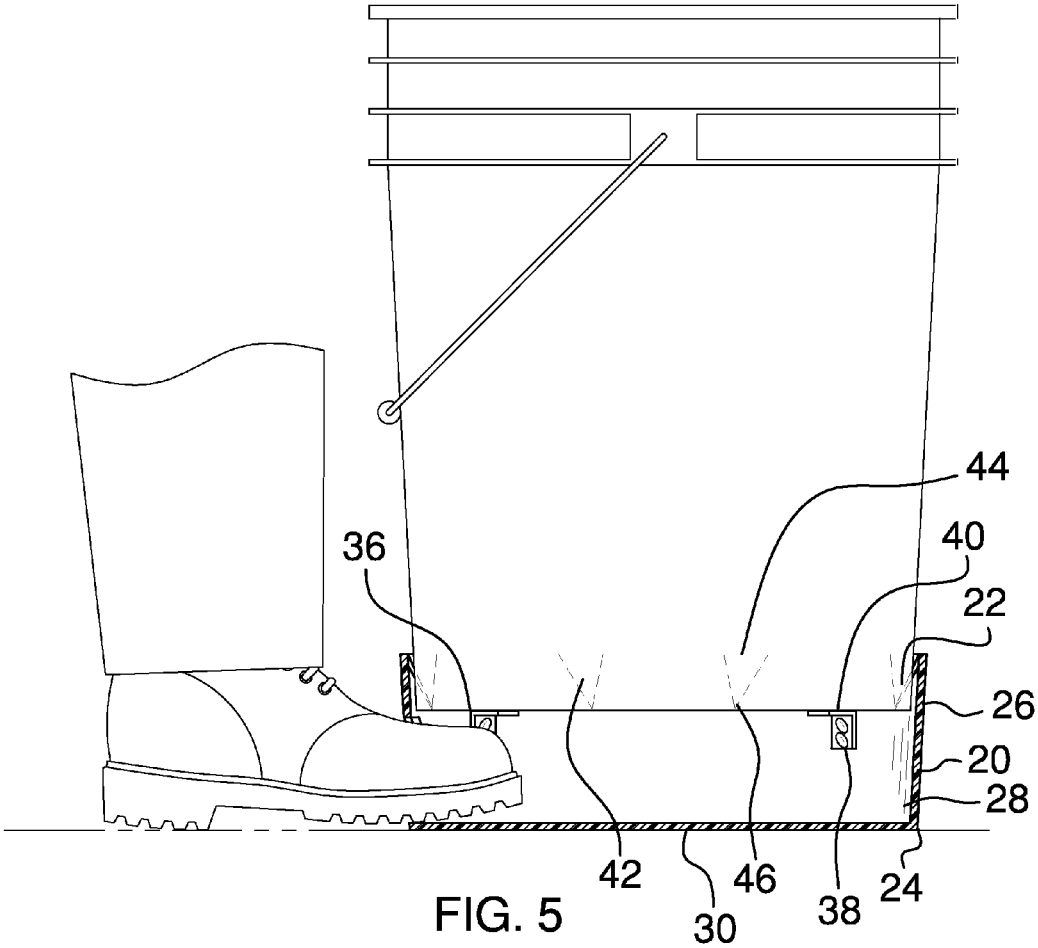
FIG. 5 is an in use cross-sectional view taken along lines 5-5 of FIG. 4.

With reference now to the drawings, and in particular FIGS. 1 through 5 thereof, an example of the instant bucket stabilizer employing the principles and concepts of the present bucket stabilizer and generally designated by the reference number 10 will be described.

Referring to FIGS. 1 through 5 the present bucket stabilizer 10 devised to secure a bucket in place while mixing the bucket's contents, such as paint, is illustrated. The bucket stabilizer 10 includes an annular wall 20 having a top perimeter 22, an inner surface 24, an outer surface 26, and a lower perimeter 28. A disk-shaped bottom side 30 is continuously attached to the lower perimeter 28. An opening 32 is disposed on the wall 20 proximal the lower perimeter 28. The opening 32 is hemispherical. In addition, the opening 32 has a convex top side 34. The opening 32 is configured to receive a user's foot therethrough to apply weight on the bottom side 30 to increase stability of the device 10 and a bucket secured therein while operating a power mixer to mix the contents of the bucket.

A plurality of spaced apart brackets 36 having a lower side 38 and an upper side 40 is disposed on the inner surface 24. The lower side 38 is disposed vertically on the inner surface 24. The upper side 40 is disposed horizontally in a position parallel to the bottom side 30. The brackets 36 are configured to support a bottom portion of a five gallon mixer bucket between the inner surface 24 of the wall 20 and the upper side 40 of each of the brackets 36.

A plurality of spaced apart semi-rigid securement tines 42 is attached to the inner surface 24 to prevent the bucket from spinning during use. Each securement tine 42 is triangular and has a base 44 and an apex 46 with the base 44 disposed on the inner surface 24 proximal the top perimeter 22 in a position parallel to the bottom side 30. The securement tines 42 are configured to removably secure a bottom portion of a five gallon mixer bucket between the inner surface 24 of the wall 20 and the bottom side 30. Compared to other shapes, the triangular shape of the securement tines accommodates removal of the bucket from the device, while preventing the spinning of the bucket.

What is claimed is:

1. A bucket stabilizer comprising:

an annular wall having a top perimeter, an inner surface, an outer surface, and a lower perimeter;

a disk-shaped bottom side continuously attached to the wall lower perimeter;

an opening disposed on the wall proximal the lower perimeter, the opening configured to receive a user's foot therethrough; and a plurality of spaced apart brackets disposed on the inner surface, the brackets configured to support a bottom side of a five gallon mixer bucket.

2. The bucket stabilizer of claim 1 wherein the brackets are right angled brackets, wherein each bracket has a lower side disposed vertically on the inner surface and an upper side disposed horizontally, in a position parallel to the bottom side.

3. The bucket stabilizer of claim 1 wherein the opening is hemispherical and has a convex top side.

4. The bucket stabilizer of claim 1 further comprising:

a plurality of spaced apart securement tines disposed on the inner surface proximal the top perimeter in a position parallel to the bottom side, the securement tines configured to removably secure a bottom portion of a five gallon mixer bucket between the inner surface of the wall and an upper side of each bracket.

5. The bucket stabilizer of claim 4 wherein the brackets are right angled brackets, wherein each bracket has a lower side disposed vertically on the inner surface and an upper side disposed horizontally, in a position parallel to the bottom side.

6. The bucket stabilizer of claim 4 wherein the securement tines are triangular, each securement tine having an apex and a base, the base being disposed on the inner surface.

7. The bucket stabilizer of claim 4 wherein the opening is hemispherical and has a convex top side.

8. The bucket stabilizer of claim 7 wherein the upper side of each of the brackets is disposed in a relative position above the opening and below the tines.

9. The bucket stabilizer of claim 4 wherein the securement tines are semi-rigid.

10. The bucket stabilizer of claim 9 wherein the upper side of each of the brackets is disposed in a relative position above the opening and below the tines.

11. The bucket stabilizer of claim 10 wherein the bucket stabilizer has a height of 17.4 inches tall and a diameter of 11.6 inches.

12. The bucket stabilizer of claim 11 wherein the opening is six inches wide.

13. A bucket stabilizer comprising:

an annular wall having a top perimeter, an inner surface, an outer surface, and a lower perimeter;

a disk-shaped bottom side continuously attached to the wall lower perimeter;

a hemispherical opening disposed on the wall proximal the lower perimeter, the opening having a convex top side, the opening configured to receive a user's foot therethrough;

a plurality of spaced apart right angled brackets disposed on the inner surface, wherein each bracket has a lower side disposed vertically on the inner surface and an upper side disposed horizontally, in a position parallel to the bottom side, wherein the upper side of each of the brackets is disposed in a relative position above the opening and below a plurality of tines, wherein the brackets are configured to support a bottom portion of a five gallon mixer bucket between the inner surface of the wall and the bottom side;

the plurality of tines are spaced apart semi-rigid triangular securement tines disposed on the inner surface proximal the top perimeter in a position parallel to the bottom side, each securement tine having an apex and a base, the base being disposed on the inner surface, wherein the securement tines are configured to removably secure a bottom portion of a five gallon mixer bucket between the inner surface of the wall and the upper side of each bracket.

* * * * *